US008317472B1

(12) United States Patent
Liang

(10) Patent No.: US 8,317,472 B1
(45) Date of Patent: Nov. 27, 2012

(54) LARGE TWISTED TURBINE ROTOR BLADE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 777 days.

(21) Appl. No.: 12/539,669

(22) Filed: Aug. 12, 2009

(51) Int. Cl.
*F01D 5/18* (2006.01)

(52) U.S. Cl. ..... 416/92; 416/97 R

(58) Field of Classification Search ..... 415/115; 416/90 R, 92, 95, 96 R, 97 R
See application file for complete search history.

(56) References Cited

U.S. PATENT DOCUMENTS 6,220,817 B1 * 4/2001 Durgin et al. ..... 416/97 R
2008/0050241 A1 * 2/2008 Liang ..... 416/97 R

* cited by examiner

*Primary Examiner* — Christopher Verdier
*Assistant Examiner* — Jason Davis
(74) *Attorney, Agent, or Firm* — John Ryznic

(57) ABSTRACT

A larger and highly twisted and tapered turbine rotor blade with a cooling circuit having a 3-pass horizontal flow serpentine circuit in a lower end of the airfoil, a 3-pass vertical flow serpentine circuit in the middle region of the airfoil, and a plurality of radial cooling channels in the upper end of the airfoil all connected in series to provide cooling for the airfoil.

6 Claims, 1 Drawing Sheet

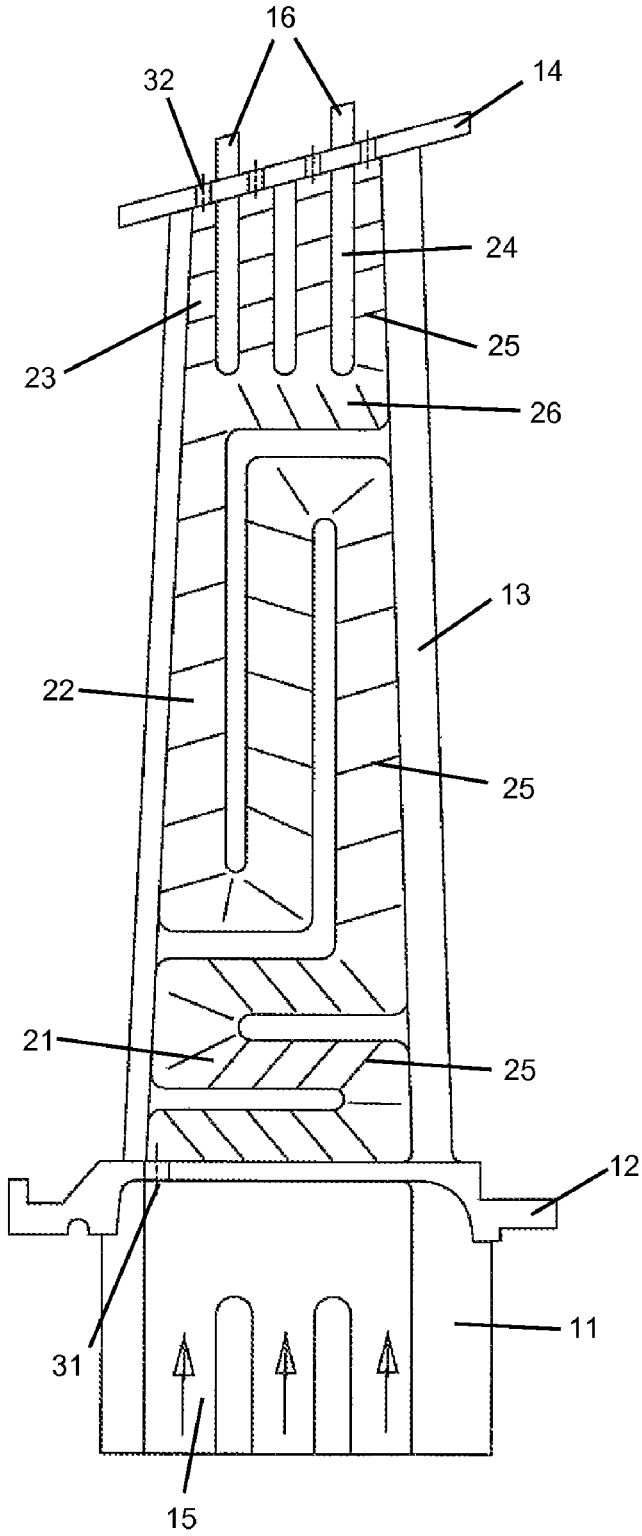
16
32
14
24
23
25
26
13
22
25
21
25
12
31
11
15

LARGE TWISTED TURBINE ROTOR BLADE

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a large air cooled blade in an industrial gas turbine engine.

2. Description of the Related Art Including Information Disclosed Under 37 CFR 1.97 and 1.98

A gas turbine engine includes a turbine with multiple rows or stages of stator vanes and rotor blades that are exposed to the hot gas flow passing through the turbine. Because of the extreme hot temperature of the gas flow, the turbine airfoils (both vanes and blades) require cooling to prevent thermal damage and to allow for higher turbine inlet temperatures that result in higher engine efficiencies. The turbine inlet temperature is limited to the first stage airfoils ability to withstand the high temperatures. The maximum useful temperature that an airfoil can be exposed to and operate according to design is based upon the material properties and the amount of cooling that can be produced for the airfoil.

A large industrial gas turbine (IGT) engine is used to produce electrical power and typically has four stages of stator vanes and rotor blades in the turbine section. The first stage rotor blade has an airfoil section that is less than one foot in spanwise length. The last stage rotor blade can be three feet in airfoil length or longer. These large IGT rotor blades can require cooling when the gas flow temperature at the latter stages is high enough to cause thermal degradation of the airfoils. Because of the larger lengths of these airfoils, the blade will require a large amount of twist from the platform to the blade tip. Prior art large turbine rotor blades are cooled by drilling radial holes into the blade from the blade tip and root sections. Limitations of drilling a long radial hole from both ends of the airfoil increases for a large and highly twisted blade airfoil. A reduction of the available airfoil cross sectional area for drilling radial holes is a function of the blade twist. Higher airfoil twist yields a lower available cross sectional area for drilling radial cooling holes. Cooling of the large and highly twisted blade by this manufacturing process will not achieve the optimum blade cooling effectiveness. U.S. Pat. No. 6,910,864 issued to Tomberg on Jun. 28, 2005 and entitled TURBINE BUCKET AIRFOIL COOLING HOLE LOCATION, STYLE AND CONFIGURATION shows this prior art blade with radial cooling holes.

BRIEF SUMMARY OF THE INVENTION

It is an object of the present invention to provide for a large and highly twisted and tapered turbine rotor blade with a cooling circuit.

It is another object of the present invention to provide for a large and highly twisted and tapered turbine rotor blade with a cooling circuit in which radial drilled cooling holes cannot be used.

It is another object of the present invention to provide for a large and highly twisted and tapered turbine rotor blade with a cooling circuit that yields a lower and more uniform sectional mass average temperature at the lower blade span height which improves blade creep life capability The above objective and more are achieved with the cooling circuit for a large and highly twisted and tapered turbine rotor blade that includes a multiple pass axial and radial flowing serpentine cooling geometry. The blade includes a horizontal 3-pass serpentine flow cooling circuit in the lower airfoil section adjacent to the platform, followed by a vertical 3-pass serpentine flow cooling circuit in the middle region of the airfoil, and then a plurality of radial flow cooling channels in the upper airfoil section adjacent to the blade tip, in which all of the cooling channels are connected in series from the lower end to the upper end of the airfoil.

BRIEF DESCRIPTION OF THE SEVERAL VIEWS OF THE DRAWINGS

FIG. 1 shows a cross section view of the multiple pass axial and radial flowing serpentine cooling circuit for a turbine rotor blade of the present invention.

DETAILED DESCRIPTION OF THE INVENTION

The present invention is a large turbine rotor blade used in an industrial gas turbine engine that has a large amount of twist and taper in which radial cooling holes cannot be used due to manufacturing limitations. FIG. 1 shows the turbine rotor blade with a root section 11, a platform 12, and airfoil section 13 and a blade tip 14. The root section 11 includes one or more cooling air supply channels 15 and a cooling air feed hole 31 to deliver cooling air to the serpentine flow circuits formed within the airfoil section. Tip rails 16 extend from the blade tip 14 to form a seal with an outer shroud of the engine casing.

The cooling circuit for the airfoil includes a 3-pass horizontal serpentine flow cooling circuit 21 with three legs or channels that each extend from a leading edge to a trailing edge of the airfoil. The first leg is connected to the feed hole 31. Each leg of the serpentine flow circuit 21 includes trip strips 25 along the side walls to promote heat transfer from the hot metal to the cooling air.

Connected downstream from the horizontal serpentine 21 is a 3-pass vertical serpentine flow cooling circuit 22 having three legs that extend along a spanwise direction of the airfoil between the leading edge and the trailing edge of the airfoil. The first leg of the vertical serpentine circuit 22 is located along the trailing edge side of the airfoil and is connected to the last or third leg of the lower horizontal serpentine circuit 21 such that the cooling air flowing through the horizontal serpentine circuit 21 then flows in series into the vertical serpentine circuit 22. Trip strips 25 are also used along the walls of the serpentine circuit 22 to promote heat transfer. The middle or vertical serpentine circuit 22 has a longer spanwise length than the other two circuits formed in the lower end and the upper end of the airfoil.

At the upper end of the airfoil is a plurality of radial cooling channels 23 formed by radial extending ribs 24 that provide cooling for the upper end of the airfoil. The last leg of the middle and vertical serpentine circuit 22 is connected to a horizontal extending common passage 26 that extends from the leading edge to the trailing edge and connects to each of the radial cooling channels 23 to pass the cooling air from the vertical serpentine circuit 22 and through the upper end of the airfoil. Each of the radial cooling channels is connected to a tip cooling hole 32 to discharge the cooling air from the airfoil and provide additional blade tip cooling. The radial cooling channels 23 extend across the airfoil from the pressure side wall to the suction side wall.

The turbine rotor blade 10 with the horizontal and vertical serpentine flow circuits and radial cooling channels can be formed in the blade during the normal casting process that forms the blade. Any cooling holes like the tip cooling holes can be drilled into the cast blade after the casting process. The trip strips are also formed in the cooling channels during the casting process.

In operation, cooling air from an external source from the rotor blade 10 is delivered to the cooling air inlet channels 15 formed within the root section 11 and then through the feed hole or holes 31 and into the beginning of the first leg of the horizontal serpentine circuit 21 to provide cooling to the lower end of the airfoil. The cooling air then flows into the middle section of the airfoil through the vertical serpentine circuit 22 to provide cooling for this section of the airfoil. The cooling air then flows out from the lest leg of the vertical serpentine circuit 22 and into the common passage 26 below the radial channels 23 which distributes the cooling air into the radial cooling channels 23 to provide cooling for the upper end of the airfoil in the blade. The cooling air from the radial channels 23 then flows out through the tip holes 32 to provide cooling for the blade tip and even the tip rails 16.

Major design features and advantages of the cooling circuits of the present invention over the prior art radial drilled designs are described below. At the lower blade span height, the cooling channel for the current serpentine flow blade cooling design is inline or at a small angle with the engine centerline. Cooling air flows axially perpendicular to the airfoil span height. This is different than in the prior art serpentine flow cooled rotor lades where the serpentine channel is perpendicular to the engine centerline and the cooling air flows in a radial inward and outward direction along the blade span.

The cooling circuit of the present invention yields a lower and more uniform sectional mass average temperature at the lower blade span height which improves blade creep life capability, especially creep at lower blade span which is an important issue to be addressed for a large, tall blade such as the $4^{th}$ stage blade in an IGT engine. The axial flow serpentine heat pickup is totally different than the prior art serpentine channel designs. In the prior art serpentine flow cooling circuits, cooling air increases temperature in the up and down passes which returns the heated air back to the lower blade span and thus reduces the blade creep capability.

The cooling circuit of the present invention is inline with the blade creep design requirement. The cooling air increases temperature in the axial serpentine cooling channel as it flows outward and thus induces a hotter sectional mass average temperature at the upper blade span. However, the pull stress at the blade upper span is low and the allowable blade metal temperature is high. Thus, it achieves a balanced thermal design by the use of the cooling design of the present invention.

Since the axial serpentine flow is initiated at the blade root section, the cooling circuit provides a cooler blade leading and trailing edge corners which enhances the blade HCF (High Cycle Fatigue) capability.

Due to a centrifugal pumping effect from rotation of the blade, the cooling air pressure increases as the cooling air flows toward the blade tip. This increase of the cooling air working pressure can be beneficial for the turn loss and friction loss in the axial serpentine cooling channel designs.

Since the cooling pressure rises due to the pumping effect, a lower cooling air supply pressure is required for the cooling circuit of the present invention than in the prior art serpentine circuits for blade cooling. This yields a lower leakage flow around the blade attachment and cooler cooling air supply temperature.

As the cooling air flows toward the blade leading edge and trailing edge, it is impinged onto the airfoil leading and trailing edge corners to create a very high rate of internal heat transfer coefficient. Subsequently, as the cooling air turns in each leading and trailing edge serpentine turn, the cooling air flow changes momentum such that an increase of heat transfer coefficient results. This combination of effects creates the high cooling for the serpentine turns at the blade leading end trailing edges.

The axial serpentine passage can be designed to tailor the airfoil external heat load by means of varying the channel height. The channel height for each individual flow channel can be different to change the cooling flow performance in the airfoil spanwise direction.

The axial flowing serpentine turns into a radial pass serpentine flow channel at the blade mid-span section as the hot gas temperature peaks at the middle of the hot gas flow path. This allows for the cooling circuit design at different mass flux distribution along the blade chordwise direction to address the chordwise heat load and metal temperature requirement.

The radial flow serpentine turns into multiple radial flowing channels at the higher blade span height when the airfoil cross sectional flow area becomes limited. The radial flow channels provide for better cooling flow distribution for cooling of the blade tip shroud as well as a ceramic core support.

I claim the following:

1. An air cooled twisted and tapered turbine rotor blade comprising:

a root section with a cooling air supply channel;

an airfoil section extending from the root section;

a blade tip on an end of the airfoil section;

a 3-pass serpentine flow cooling circuit formed in a lower end of the airfoil section and having legs that extend in a horizontal direction;

a 3-pass serpentine flow cooling circuit in a middle section of the airfoil section and having legs that extend in a vertical direction;

a plurality of radial cooling channels formed in an upper end of the airfoil;

the horizontal 3-pass serpentine circuit connected to the vertical 3-pass serpentine circuit which is connected to the plurality of radial cooling channels; and, each radial cooling channel connected to a tip cooling hole to discharge the cooling air through the blade tip.

2. The turbine rotor blade of claim 1, and further comprising:

the three legs of the horizontal serpentine flow circuit extend from a leading edge to a trailing edge of the airfoil.

3. The turbine rotor blade of claim 1, and further comprising:

the three legs of the vertical serpentine flow circuit extend from a leading edge to a trailing edge of the airfoil.

4. The turbine rotor blade of claim 1, and further comprising:

a chordwise extending common channel is formed between the 3-pass vertical serpentine circuit and the plurality of radial cooling channels to channel the cooling air from the serpentine to the radial channels.

5. The turbine rotor blade of claim 1, and further comprising:

a feed hole to connect the cooling air supply channel within the root section to the first leg of the horizontal 3-pass serpentine flow circuit.

6. The turbine rotor blade of claim 1, and further comprising:

the horizontal and the vertical 3-pass serpentine circuits and the radial channels form an airfoil cooling circuit that extends from the root section to the blade tip.

* * * * *